US012735214B2

(12) United States Patent
Gaul et al.

(10) Patent No.: US 12,735,214 B2
(45) Date of Patent: Sep. 15, 2026

(54) SYSTEMS AND METHODS FOR OXYGEN FREE PACKAGING

(71) Applicant: PROTOCOL LAB, LLC, Santa Monica, CA (US)

(72) Inventors: Tyler Gaul, Los Angeles, CA (US); Thomas Wolverton Gaul, Thornton, CO (US); Davis Finlay Gaul, Denver, CO (US)

(73) Assignee: PROTOCOL LAB, LLC, Santa Monica, CA (US)

( * ) Notice: Subject to any disclaimer, the term of this patent is extended or adjusted under 35 U.S.C. 154(b) by 0 days.

(21) Appl. No.: 18/765,975

(22) Filed: Jul. 8, 2024

(65) Prior Publication Data

US 2024/0359846 A1 Oct. 31, 2024

Related U.S. Application Data

(62) Division of application No. 17/328,439, filed on May 24, 2021, now Pat. No. 12,030,680.

(Continued)

(51) Int. Cl.
*B65B 31/02* (2006.01)
*B65B 1/04* (2006.01)

(Continued)

(52) U.S. Cl.
CPC ..... *B65B 31/025* (2013.01); *B65B 1/04* (2013.01); *B65B 57/00* (2013.01); *B65B 55/027* (2013.01)

(58) Field of Classification Search
CPC ..... B65B 31/025; B65B 1/04; B65B 57/00; B65B 55/027; B31B 31/04; B31B 31/06
See application file for complete search history.

(56) References Cited

U.S. PATENT DOCUMENTS 3,245,194 A * 4/1966 Carski ..... B65B 3/003 53/489
3,891,779 A * 6/1975 Robinson ..... B65B 55/06 426/399

(Continued)

OTHER PUBLICATIONS

"Protecting pharmaceuticals with 'humidity-neutral' oxygen scavengers." In: Healthcare Packaging. Dec. 5, 2012. 26 pages. Retrieved from <https://www.healthcarepackaging.com/markets/pharmaceutical/article/13286698/protecting-pharmaceuticals-with-humidityneutral-oxygen-scavengers#next-slide>.

(Continued)

*Primary Examiner* — Daniel Jeremy Leeds
(74) *Attorney, Agent, or Firm* — LOEB & LOEB LLP

(57) ABSTRACT

A method for packaging products in a substantially oxygen free environment. The method includes providing a containment environment including a main chamber formed by main chamber walls, an exhaust portion for removing ambient air from the main chamber, an intake portion for introducing inert gas into the main chamber, and a selectively sealable access point for providing access into and out of the main chamber. The method includes providing a bulk product dispenser and one or more individual bottles into the main chamber, and sealing the main chamber at least by closing the sealable access point. The method includes purging ambient air from the main chamber through the exhaust portion and introducing inert gas into the main chamber through the intake portion. The method includes transferring a product from the bulk product dispenser to each of the one or more individual bottles, and sealing each of the individual bottles.

20 Claims, 6 Drawing Sheets

Related U.S. Application Data

(60) Provisional application No. 63/028,722, filed on May 22, 2020.

(51) Int. Cl.
*B65B 55/02* (2006.01)
*B65B 57/00* (2006.01)

(56) References Cited

U.S. PATENT DOCUMENTS 4,240,242 A 12/1980 Grey
4,512,951 A 4/1985 Koubek
5,884,457 A * 3/1999 Ortiz ..... B65B 7/2835 53/492
6,094,887 A * 8/2000 Swank ..... B65B 55/04 53/167
6,514,552 B1 * 2/2003 Sivetz ..... A23F 5/105 426/466
8,020,360 B2 9/2011 Biotti
8,506,900 B1 8/2013 Ricciardi
11,241,513 B1 2/2022 Ricciardi
12,030,680 B2 7/2024 Gaul
2002/0134051 A1 * 9/2002 Kurth ..... B65B 55/103 53/425
2007/0082601 A1 4/2007 Desrochers
2008/0139865 A1 6/2008 Galliher
2008/0175888 A1 7/2008 Lindemann
2008/0206325 A1 * 8/2008 Bouquerand ..... A23L 27/72 424/463
2008/0293997 A1 11/2008 Buhlmann
2009/0223592 A1 9/2009 Procyshyn
2010/0296967 A1 * 11/2010 Yamamoto ..... A23B 7/0056 422/26
2012/0222774 A1 * 9/2012 Husnu ..... B65B 37/06 141/69
2012/0297732 A1 * 11/2012 Dupont ..... B67C 3/222 53/510
2015/0230492 A1 * 8/2015 Day, Jr. ..... B65B 29/00 426/232
2015/0364252 A1 * 12/2015 Sagawa ..... B65B 1/16 141/37
2016/0013452 A1 1/2016 Zhang
2016/0133996 A1 5/2016 Fukuhara
2017/0121046 A1 5/2017 Diaz
2017/0355518 A1 12/2017 Zita
2021/0362893 A1 11/2021 Gaul

OTHER PUBLICATIONS

Lighthouse Instruments, "Filling Line Nitrogen Purge Qualification In Manufacturing." In: Pharmaceutical Online. Retrieved from <https://www.pharmaceuticalonline.com/doc/filling-line-nitrogen-purge-qualification-in-nanufacturing-0001>.
Muhammad Ali Sheraz et al., "Stability and Stabilization of Ascorbic Acid." In: Household and Personal Care Today. vol. 10(3). May/Jun. 2015. pp. 22-25.
Office Action (Final Rejection) dated Jun. 29, 2023 for U.S. Appl. No. 17/328,439 (pp. 1-18).
Office Action (Non-Final Rejection) dated Oct. 13, 2023 for U.S. Appl. No. 17/328,439 (pp. 1-19).
Office Action (Non-Final Rejection) dated Dec. 27, 2022 for U.S. Appl. No. 17/328,439 (pp. 1-13).
Office Action (Notice of Allowance and Fees Due (PTOL-85)) dated Mar. 20, 2024 for U.S. Appl. No. 17/328,439 (pp. 1-10).
Office Action dated Jun. 29, 2023 for U.S. Appl. No. 17/328,439 (pp. 1-19).
Vivianne Y. Collin et al., "Wyeth Carolina Uses PAT to Monitor an Oxygen-Sensitive New Parenteral." In: Pharma Manufacturing. Dec. 20, 2005. 8 pages. Retrieved from <https://www.pharmamanufacturing.com/articles/2005/414/>.
Office Action (Non-Final Rejection) dated Apr. 7, 2026 for U.S. Appl. No. 18/922,183 (pp. 1-15).
Pharmaceutical Biology, 2016 vol. 54, No. 12, 3203-3210. (Year: 2016).

* cited by examiner

SYSTEMS AND METHODS FOR OXYGEN FREE PACKAGING

CROSS-REFERENCE TO RELATED APPLICATIONS

This application is a divisional application of U.S. application Ser. No. 17/328,439, filed May 24, 2021, now U.S. Pat. No. 12,030,680, which claims priority to U.S. Provisional Application No. 63/028,722, filed May 22, 2020, the disclosures of each of which are incorporated by reference herein.

TECHNICAL FIELD

The present invention relates to product packaging and, more specifically, to packaging cosmetic skincare products.

BACKGROUND

Some ingredients in certain products, such as skincare products of other cosmetics, may be compromised by exposure to oxygen, UV light, varying temperatures, and other factors. This exposure may occur at any point during the lifecycle of a product, such as during manufacturing, packaging, bottling, storage, transport, extraction, application, etc. Exposure to any of these factors at any point during a product life cycle may result in diminished shelf life of the product and diminished effectiveness of the ingredients. Traditional systems and methods designed to alleviate exposure to these factors fall short or fail to reduce oxygen exposure at one or more points in the product life cycle. Additional measures are needed to improve upon the traditional processes.

SUMMARY

In an embodiment, the disclosure describes a system for packaging products in a substantially oxygen free environment. The system may include a bulk product dispenser including a product, one or more individual bottles, one or more pressurized gas tanks containing an inert gas, a vacuum pump, and a containment environment. The containment environment may include a main chamber formed by main chamber walls. The main chamber may be configured for housing at least the bulk product dispenser and the one or more individual bottles and an exhaust portion in fluid communication with the main chamber. The exhaust portion may include at least one exhaust valve and configured to be removably connected to the vacuum pump so as to provide for removal of gas from the main chamber through the exhaust portion using the vacuum pump. The containment environment may include an intake portion in fluid communication with the main chamber. The intake portion may include at least one intake valve and removably connected to the one or more pressurized gas tanks so as to provide for entry of the inert gas into the main chamber through the intake portion.

In another embodiment, the disclosure describes a method for packaging products in a substantially oxygen free environment. The method may include providing a containment environment including a main chamber formed by main chamber walls, an exhaust portion for removing ambient air from the main chamber, an intake portion for introducing inert gas into the main chamber, and a selectively sealable access point for providing access into and out of the main chamber. The method may include providing a bulk product dispenser and one or more individual bottles into the main chamber, sealing the main chamber at least by closing the sealable access point, and purging ambient air from the main chamber through the exhaust portion. The method may include introducing inert gas into the main chamber through the intake portion, transferring a product from the bulk product dispenser to each of the one or more individual bottles, and sealing each of the individual bottles.

In another embodiment, the disclosure describes a containment apparatus for performing substantially oxygen free packaging. The containment apparatus may include a hood including an inert gas source and a product source, the hood including a bottom surface. The apparatus may include one or more chamber walls connected to the bottom surface of the hood and a conveyor surface configured to selectively engage the one or more chamber walls so as to form a containment environment between the bottom surface of the hood, the one or more chamber walls, and the conveyor surface. The apparatus may include a purging valve disposed in the one or more chamber walls. The purging valve may be in fluid communication with the containment environment and configured to permit a target gas to pass out of the containment environment. The apparatus may include one or more dual nozzles disposed in the containment environment and configured to dispense an inert gas into the containment environment from the inert gas source and a product into the containment environment from the product source. The conveyor surface may be configured to position one or more bottles in the containment environment so as to receive the product from the one or more dual nozzles, and the one or more dual nozzles is configured to dispense the inert gas into the one or more bottles while dispensing the product.

BRIEF DESCRIPTION OF THE DRAWINGS

Non-limiting and non-exhaustive embodiments are described in reference to the following drawings. In the drawings, like reference numerals refer to like parts through all the various figures unless otherwise specified.

For a better understanding of the present disclosure, a reference will be made to the following detailed description, which is to be read in association with the accompanying drawings, wherein.

DETAILED DESCRIPTION

Figure 1:
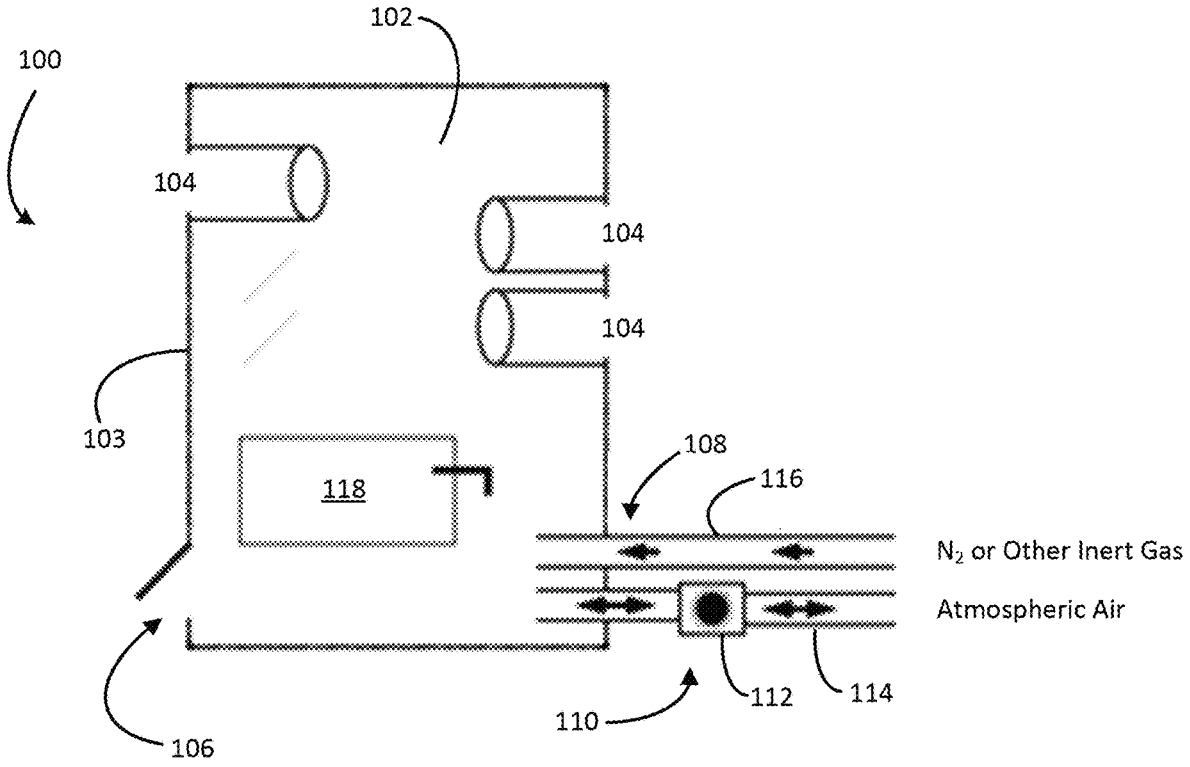
FIG. 1 is a schematic view of an embodiment of a containment environment in accordance with the disclosure.

The disclosure describes, in some embodiments, systems and methods for providing a substantially oxygen-free packaging environment for products that may include ingredients sensitive to oxygen and other environmental factors. In some embodiments, the disclosure describes systems and methods that may protect key ingredients from exposure to oxygen and ultraviolet (UV) light during manufacturing processes, such as when transferring ingredients from larger containers, such as vats, into consumer-ready containers. In some embodiments, the systems and methods described herein may be used to transfer viscous serum forms of key ingredients, such as L-ascorbic acid (i.e., vitamin C), retinaldehyde, and/or other oxygen-sensitive ingredients, from large-scale vats into individual, consumer-ready airless bottles. Such methods and systems may provide for protection of the key ingredients from air and light during and after use using packaging that may be consumer friendly for accurate, airless dosing.

Certain skincare product ingredients may become compromised through exposure to certain environmental factors, oxygen and UV light. Specifically, skincare product formulas containing retinoic acid and vitamin C (or their derivatives and precursors) may be vulnerable to degradation. For example, retinaldehyde may be more potent and faster absorbing than standard retinol, but also significantly more unstable. Additionally, retinaldehyde may convert directly to retinoic acid when applied to human skin, which is a goal of using retinol-based skincare products. Additionally, ascorbic-acid (pure vitamin C), is the most potent, effective, and unstable version of vitamin C.

Retinol products, retinaldehyde, and vitamin C may increase skin health in various ways. However, these ingredients may lose efficacy when exposed to certain temperatures, such as temperature above 74 degrees Fahrenheit, to oxygen (O2) gas, and/or UV light. Even so, traditionally, very little is done, particularly in the cosmetics industry, to maintain the integrity of delicate skin care ingredients. As a result, products using derivative or chemically degraded forms of retinol or ascorbic acid may be less effective but can still claim to be a "Vitamin C serum" or a "retinol serum" because certain industries, such as the cosmetic industry, may be not prevent such claims. The systems and methods described herein may provide for skincare and other products that have substantially eliminated or minimized degradation of key ingredients such as vitamin C, retinaldehyde, and/or other oxygen-sensitive substances.

Product ingredients may be in danger of degradation at certain key points during the manufacturing and distribution process. For example, when a product is in transit, or is transferred from container-to-container, or is dispensed by a consumer from the container, the product may contact relatively extreme temperatures, UV light, and/or oxygen. Currently, regulators in the United States do not regulate these ingredients and no standardized processes exist for regulating product quality in certain industries, such as the skin care product industry.

In some embodiments, the systems and methods for oxygen free product packaging described herein may help to protect key ingredients in skincare products for substantially the entire time those ingredients are in the manufacturer's possession and in consumer's possession. It may be beneficial to protect delicate key ingredients from degradation at each point during the product life cycle, including during manufacturing of an original formula in large vats (i.e., a macro stage), during storage, during bottling (i.e., micro stage), transportation, and warehousing.

Although existing manufacturing systems and processes used by skincare or pharmaceutical manufactures may provide compounds containing forms of retinol, these products are traditionally injected into foil tubes and capped with no ambient air inside in an attempt to limit oxygen exposure and may only be viable using pastes or creams (i.e., relatively high viscosity products). The systems and methods described herein, however, may provide for bottling or otherwise packaging products that may include less viscous materials, such as serum compounds, in a substantially airless bottle or container without exposing the compound to ambient oxygen or UV light during packaging, during storage, or during consumer dosing. Traditional packaging processes may be most vulnerable when transferring product ingredients from large, bulk containers into separate, individual containers such as consumer-ready units.

More specifically, in some embodiments, the disclosure describes systems and methods for protecting key ingredients of compounds, like vitamin C and retinal, from oxygen and UV light during the bottling process. In some embodiments, the disclosure describes a method of packaging products that may include transferring key ingredient serums from a macro storage stage to a consumer-ready micro storage stage by sealing accurate-dosing airless actuators inside a containment environment described in greater detail below. In some embodiments, the containment environments may include one or more mechanisms for removing a target gas, such as oxygen, from the environment surrounding the packaging components and filling the space with an inert gas. In some embodiments, the methods and systems may also include mechanisms or procedures for removing additional target gas molecules using jets or blasts of inert gas applied to the surfaces of the containment environment or the packaging components (e.g., bottles, caps, actuators, dispensers, dosers, etc.). Some embodiments provide for removing the target gas from an entire volume, surrounding packaging components, while other embodiments may also or alternatively include removing the target gas locally, for example, from the immediate space or surfaces of a bottle receiving a product using active inert gas blasting or application. Generally, the systems and methods described herein may limit or substantially eliminate exposure of oxygen-sensitive ingredients and products to a target gas (e.g., oxygen) during the packaging process so as to limit product degradation.

FIG. 1 is a schematic view of an embodiment of a containment environment 100 that may be used to provide a substantially oxygen-free environment for product packaging. The containment environment 100 may be a chemically and physically stable area where key ingredients or compounds may be manipulated, transferred, inspected, and otherwise handled by humans and machines in a way that may minimize risk of ingredient degradation due to atmospheric factors such as oxygen, UV light, variable or damaging temperatures, bacteria, pollutants, etc. The containment environment 100 may be a substantially air-tight, physically isolated chamber or series of air-tight chambers that may be purged of substantially all oxygen or other targeted gas. Once the targeted gas (e.g., oxygen) has been removed from the containment environment 100, key ingredients that would be otherwise subject to degradation upon exposure to the targeted gas may be transferred between containers or otherwise handled within the containment environment. In some embodiments, the containment environment 100 may include one or more partitions, may be configured for remote operation, may include one or more gloved access points, etc. In some embodiments, it is contemplated that gloves may not be used at all, but instead equipment for transferring product from a bulk container into the individual bottles may be remotely controlled either through wired or wireless means. In some embodiments, the equipment may be configured to operate automatically to perform steps of monitoring and adjusting the containment environment, preparing the key ingredients for transfer, and transferring the key ingredients or products from bulk containers into individual bottles. The equipment may be sealed into the main chamber walls in a manner that allows product to flow into the main chamber with a filling machine housed outside the main chamber. In some embodiments, the interior and exterior of the containment environment 100 may be cleaned with disinfecting agents, purged of atmospheric air using methods described herein or otherwise, and may be refilled with inert gas that may not degrade the key ingredients (e.g., Nitrogen, Argon, Helium).

In some embodiments, the containment environment 100 may include a main chamber 102, one or more gloves 104 or other suitable access mechanisms, one or more sealable access points 106, an intake portion 108, and an exhaust portion 110. The main chamber 102 may be defined by main chamber walls 103 and configured to hold any equipment used to handle key ingredients, monitor and adjust environmental factors, such as pressure, temperature, and gases present, or otherwise treat the equipment or ingredients. In some embodiments, the main chamber walls 103 may be made from sheets of transparent or colored fire-retardant polyvinyl chloride (PVC), which may be between 10 mmm and 20 mm thick, and may be 12 mm and 20 mm thick in different portions. In some embodiments, the main chamber walls 103 may be flexible so as to contract and expand during the deflation and inflation processes described herein. In some embodiments, the main chamber walls 103 may instead by rigid or substantially rigid, either using supportive framing or structures to keep the walls in place or using a rigid material for the walls. The gloves 104 may be integral with the main chamber walls 103, or be otherwise connected to the main chamber walls so as to provide air-tight handling of material inside the main chamber 102. In some embodiments, gloves 104 may be disposed in the main chamber 102 walls at various points around the main chamber 102 to provide a user with various points of access for ease of handling of objects within the main chamber. The gloves 104 may be disposed on the main chamber 102 such that a user may insert hands into the gloves through the main chamber walls 103 without compromising the air-tight seal of the containment environment 100. In some embodiments, the gloves 104 may be made from injected molded PVC. In some embodiments, the containment environment may not include any gloves at all, for example, in some embodiments where the equipment disposed within the main chamber 102 may be automated or otherwise controlled remotely or with other suitable manipulations.

The one or more access points 106 may provide access into and out of the main chamber 102 through the main chamber walls 103. In some embodiments, the access point 106 may be selectively opened and closed with a zipper, such as a water and air-tight sealing zipper. The access point may be opened to access the interior of the containment environment 100 when air-tight conditions are not necessary. In some embodiments, portions of the containment environment 100, such as the seams and areas where gloves join the main chamber walls, may be constructed using radio-frequency heat sealed seams that may be tested to ensure integrity under pressure to verify containment. In some embodiments, a support structure may be included in the containment environment 100, such as using stainless steels, a cord suspension system, or other framing, to support or suspend the containment environment for ease of use. The framing suspension structure may allow for the flexible main chamber walls 103 to be detached from the frame during purging to allow for deflation and re-inflation to adjust gas levels inside the containment environment. For example, after all materials are loaded into the containment environment and the main chamber has been sealed, the main and/or auxiliary chambers may be disconnected from the support structure. In some embodiments, when the exhaust valve 112 is activated, vacuum pressure may remove as much gas as possible by sucking the chamber walls 103 inward. The chambers may then be re-inflated using inert gas and the chamber walls may be reattached to the support frame for ease of use.

In some embodiments, the exhaust portion 110 may be used to purge or otherwise remove air or other gases from within the main chamber 102, and the intake portion 108 may provide for particular gases, such as nitrogen, to enter the main chamber, such as after purging. The intake portion 108 may have HEPA filters or other air purifying filters installed inline within the intake tubes 116 to ensure that the inert gasses do not bring particulate pollution into the sealed chamber or chambers. In some embodiments, the exhaust portion 110 may include one or more exhaust valves 112, which may include manual hand or electronically operated valves, ball check valves, or other one-way valves to allow gasses out of the main chamber 102 but not back into the chamber. Those skilled in the art will understand that other types of valves or combinations of valves may be used to exhaust air from the main chamber 102. In some embodiments, a manual valve and ball check valve may be disposed in series such that the manual valve may fully seal the exhaust portion 110 regardless of the positioning of the ball check valve. This may allow for detachment of the containment environment from its surroundings for moving or adjusting the workspace. In some embodiments, the exhaust portion 110 may include a vacuum pump with a vacuum hose 114 connected to the valves 112. In some embodiments, the vacuum hose 114 may be connected during the purging process but may be selectively or temporarily removed once purging of the main chamber 102 may be completed. This may allow for the environment to be self-isolated and may be moved independently of the gas tanks and vacuum pumps used to purge and inflate the main chamber 102. The vacuum pump may be activated to pull ambient air out of the main chamber 102 through the valves 112 of the exhaust portion 110.

In some embodiments, the intake portion 108 may include a one-way, self-sealing valve for gas intake into the main chamber 102. Those skilled in the art will understand that other types of valves may be suitable for use in accordance with the disclosure. In some embodiments, a gas hose 116 may be removably connected to the intake portion 108 and provide access into the main chamber 102 for inert gases, such as nitrogen, argon, helium, etc., through the self-sealing valve. In some embodiments, the gas hose 116 may be connected during filling of the main chamber 102 and removed once filling is complete, sealing the gas inside the main chamber with one or more valves in the intake portion 108. In some embodiments, the intake portion 108 and the exhaust portion 110 may be the only point in the containment environment 100 through which gases may enter and/or exit the containment environment after sealing. In some embodiments, connection points may be sealed air-tight using adhesives, tie-offs, and/or redundant seals to secure the one-way inflation valve, hose, and exhaust valve to the main chamber.

In some embodiments, various other equipment may be included within the containment environment 100 to perform the packaging operations. For example, certain packaging processes may include a manually or automatically operated, piston-action, stainless steel serum doser 118 that may be used for filling consumer units, bottles, or other individual packaging. One or more sensors may be used in establishing and maintaining desired environmental conditions within the containment environment 100, such as electronic oxygen sensors, temperature sensors, pressure sensors, UV or other light sensors, etc. Other equipment may include a capper to seal consumer units after dosing is complete. In some embodiments, the capper may be a manually or automatically operated drill press that may be modified for capping and sealing. Individual bottle units or other individual packaging may be included within the containment environment 100 for filling from the doser 118. In some embodiments, the individual bottles may be designed so as to be irreversibly sealable only once. In some embodiments, airless and UV-proof bottles and actuators may deliver the serum without exposing the serum to anything outside of the bottle, including air and UV radiation. In some embodiments, the bottles may include a UV-proof foil pouch within a bottle body. The serum or other product may be stored in the foil pouch, and may be compressed by pumping an actuator on the bottle. In some embodiments, no air is pushed into the foil pouch, but may be introduced into the bottle body around the foil pouch to compress the pouch and force the product out of a dispenser. Because no air is provided into the foil pouch, the product remaining in the foil pouch after dispensing may not be exposed to ambient air and thus may not experience oxygen degradation. Those skilled in the art will understand that other forms of airless or other bottles may be used in accordance with the disclosure.

Figure 2:
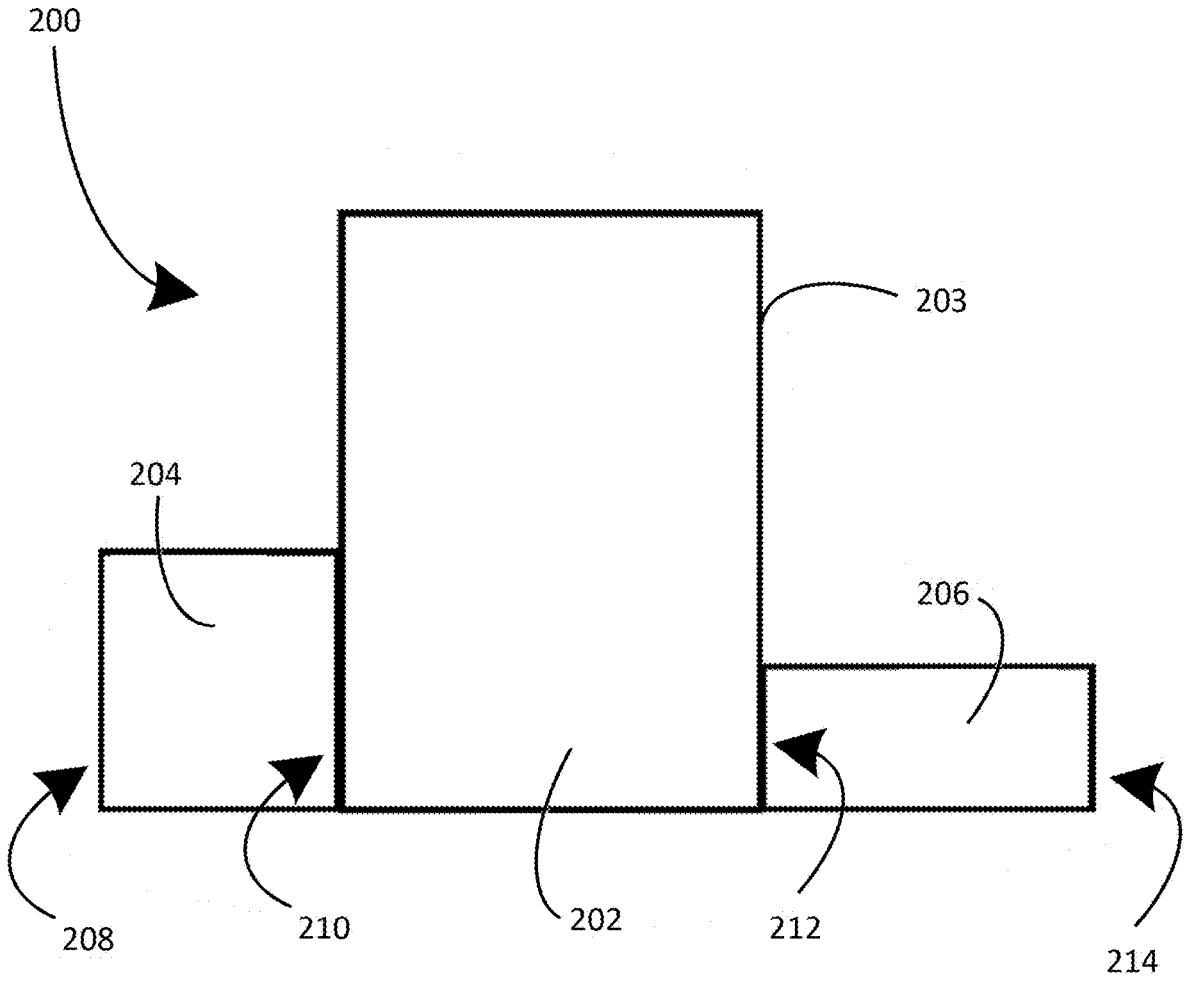
FIG. 2 is a diagram another embodiment of a containment environment in accordance with the disclosure.

FIG. 2 is a diagram of another embodiment of a containment environment 200 that may have many features similar to that of containment environment 100. The containment environment 200 may include a main chamber 202 formed by main chamber walls 203, which may be substantially similar to the main chamber walls 103 for the main chamber 102 described with respect to FIG. 1. The main chamber 202 may house equipment used in the packaging process and may include gloves or other means to access and handle the equipment inside the main chamber. The containment environment 200 may also include a first airlock 204 and a second airlock 206. The first airlock 204 may include a first airlock entrance 208 and a first airlock exit 210. The second airlock 206 may include a second airlock entrance 212 and a second airlock exit 214. The first airlock entrance 208 may be selectively opened to grant access to the first airlock 204. The first and second airlock entrances 208, 212 and the first and second airlock exits 210, 214 may be closed to become substantially air-tight, such as by using an air-tight zipper or other suitable closure. In such embodiments, the main chamber 202 may be substantially purged of oxygen or other targeted gasses and filled with inert gas while sealed off from the first and second airlocks 204, 206. Using the first and second airlocks 204, 206, equipment, such as bottling materials and equipment to aid in bottling and oxygen purging, may be passed into and out of the main chamber 202 without compromising the seal of the main chamber. For example, the first airlock exit 210 may be sealed and the first airlock entrance 208 opened to admit equipment into the first airlock 204. Once the equipment is placed inside the first airlock 204, the first airlock entrance 208 may be sealed, the first airlock may be purged of ambient air using an exhaust portion similar to that described above with reference to FIG. 1, and inert gas may be introduced into the first airlock 204 in a manner similar to that described above. Once the first airlock 204 has achieved the desired levels of gas mixture, the first airlock exit 210 may be opened to provide access to the equipment from the first airlock into the main chamber 202. In such a manner, additional equipment may be introduced into the main chamber 202 without compromising the sealed environment and any product stored inside the main chamber.

A similar procedure may be used to remove equipment from the main chamber 202, such as filled individual bottles or waste products. For example, the second airlock entrance and exit 212, 214 may be closed, the second airlock 206 purged, and then filled with the desired inert gas to match that of the main chamber 202. The second airlock entrance 212 may then be opened to provide access from the main chamber 202 into the second airlock 206. The second airlock entrance 212 may then be sealed again to seal off the main chamber 202, and the second airlock exit 214 may be opened to provide for the equipment to be removed from the second airlock without compromising the conditions within the main chamber.

Figure 3A:
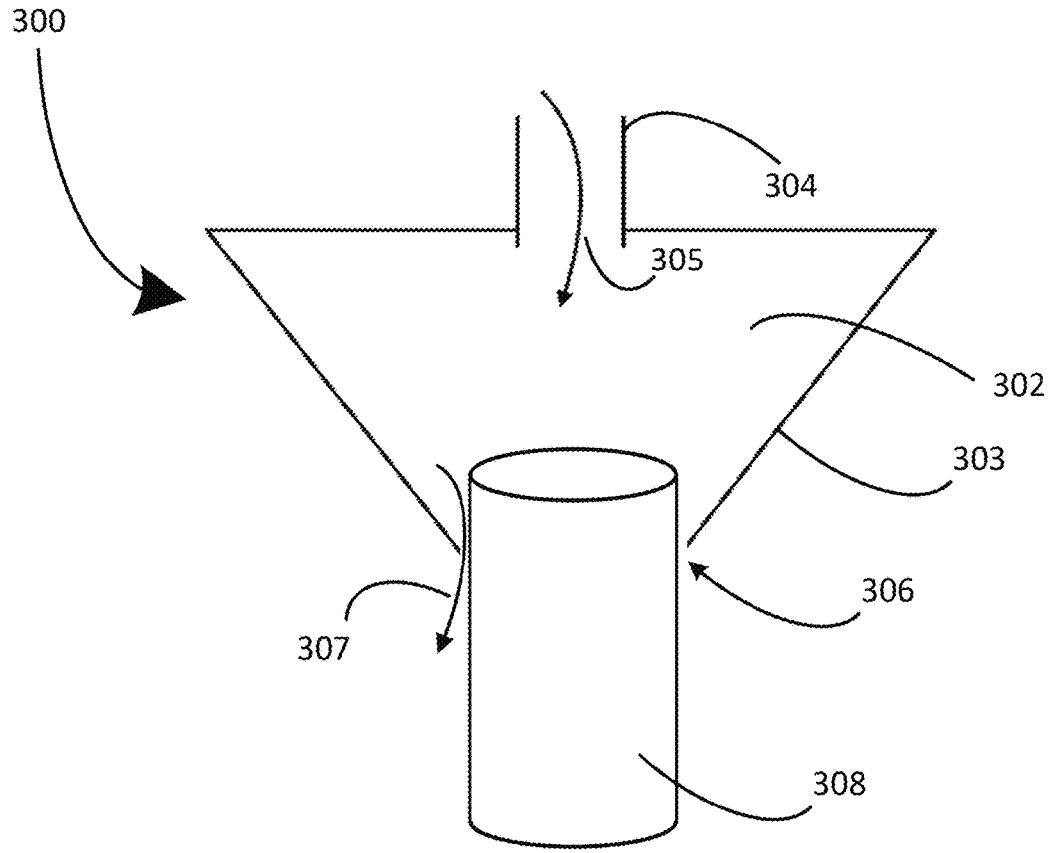
FIGS. 3A and 3B are diagrams of another embodiment of the containment environment in accordance with the disclosure.
Figure 3B:
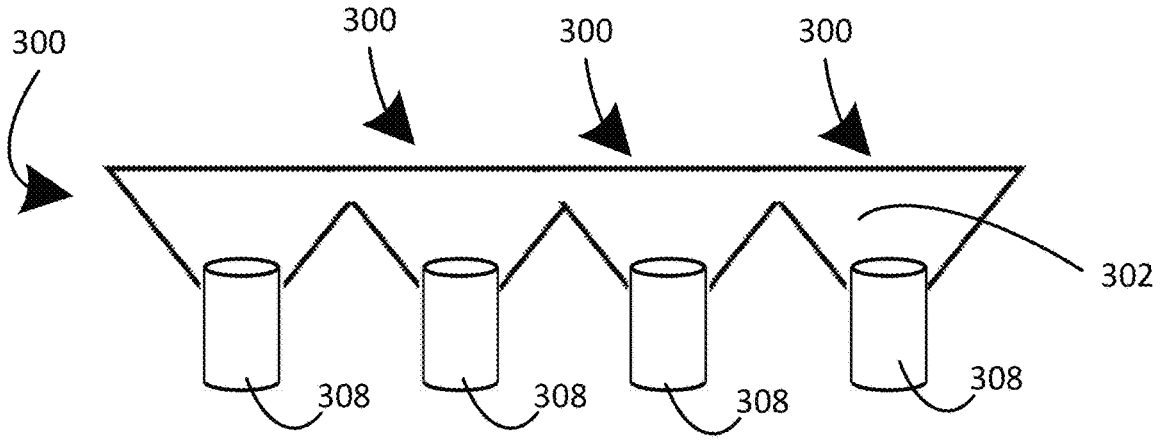

FIG. 3A is another embodiment of a containment environment 300 that may be configured for use on a single bottle 308 or other packaging. The containment environment 300 may include a main chamber 302 formed by main chamber walls 303. The containment environment 300 may include an intake 304 and a dilatable bottle seal 306 that may form a seal around a bottle 308. In some embodiments, inert gas may be forced into the main chamber 302 through the intake 304, such as in a blast of inert gas 305. The blast of inert gas 305 may cause the bottle seal 306 to dilate around the bottle, forcing ambient air 307, including oxygen, out of the main chamber 302 through the bottle seal. The process may be repeated until the desired atmospheric gas levels within the chamber 302 may be achieved. The key ingredients may then be introduced into the bottle 308 in the main chamber 302 without exposure to oxygen or other degrading gases. FIG. 3B illustrates multiple individual embodiments of the containment environment 300 that may be used simultaneously to fill any number of bottles 308. In some embodiments, the main chamber 302 may be one contiguous main chamber that may be filled through one or more intakes. In such embodiments, it is contemplated that purging the ambient air with inter gas may provide a substantially oxygen-free environment for multiple bottles 308 at once. In some embodiments, each individual bottle 308 may alternatively be partially contained within its own dedicated chamber that may be sealed off from other adjacent chambers.

Figure 4:
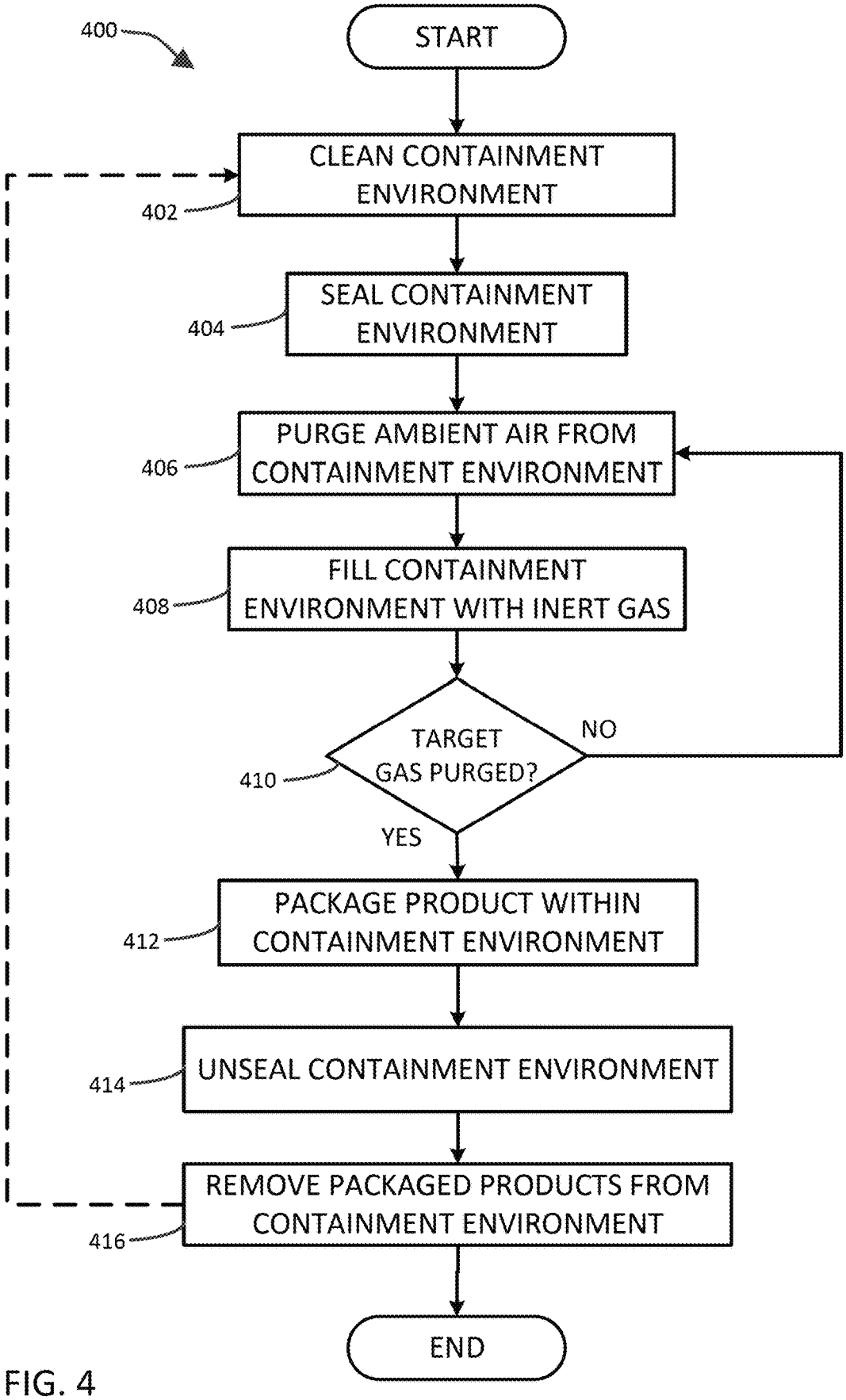
FIG. 4 is a flow chart illustrating an embodiment of a method of packaging a product in a substantially oxygen free environment in accordance with the disclosure.

FIG. 4 is a flow chart 400 of an embodiment of using a containment environment as disclosed herein to package products in a substantially oxygen-free environment. Serums or other key ingredients or products may be received and inspected to confirm proper temperatures, viscosity, appearance, etc. At 402, the method may include cleaning and disinfecting the containment environment. Cleaning may include using multiple disinfecting and sanitizing agents on the interior and exterior surfaces of the containment environment and its components. The containment environment may also be located in a location with substantially no atmospheric light or UV-emitting devices. In some embodiments, cleaning may also include cleaning and/or disinfecting the valves included in the intake and exhaust portions of the containment environment. Cleaning may also include cleaning and disinfecting serums, tools, bottles, and other equipment to be used within the containment environment. At 404, the method may include sealing the containment environment, which may include sealing the intake hose to a regulator on a pressurized gas tank holding an inert gas and sealing the exhaust portion using, for example, a gate valve. In some embodiments, the pressurized gas tank may be stored in the same room or environment as the containment environment to help ensure temperature consistency across all substances that may contact the key ingredients and/or serums. Once the desired equipment is within the containment environment, sealing the containment environment may include closing the access points, such as by closing an air-tight zipper or other suitable sealing methods.

At 406, the method includes purging ambient air from the containment environment. In some embodiments, purging may include attaching a vacuum pump to the exhaust valves and opening a manual or automatic exhaust valve to allow ambient air to flow out of the containment environment. The vacuum pump may be activated to remove atmospheric air from within the containment environment through the exhaust valves, which may create negative pressure and deflation within the containment environment. Once a maximum amount of gas is removed from the containment environment, the manual exhaust valve may be closed and the vacuum removed. The containment environment may be inspected for leaks under strain, or may be left to rest for a predetermined time to ensure no leaks are present. At 408, the method may include filling the containment environment with pressurized, inert gas through a regulator and intake portion. In some embodiments, the containment environment may be filled to greater than atmospheric pressure and may be inspected for leaks under pressure, or left to rest and confirm that the pressure is not dropping. At 410, the method may include determining whether the atmosphere inside the containment environment includes less than a predetermined maximum allowable level of targeted gas, such as oxygen. In some embodiments, the maximum allowable level of target gas may be about 0.2% or less than 0.2%. In some embodiments, the maximum allowable level of target gas may be less than or equal to about 0.5%, or less than or equal to about 1.0%. In some embodiments, the maximum allowable level of target gas may be less than or equal to about 1.5%, or less than or equal to about 2.0% If the target gas is found to be present in levels above the maximum allowable level, then the method may include returning the 406 to purge the containment environment, refill the containment environment with inert gas at 408, and checking the gas levels again. In some embodiments, the containment environment may be purged and re-filled multiple times, such as at least three times, regardless of the determined level of targeted gas within the containment environment. In some embodiments, once the levels of targeted gas may be below the predetermined maximum allowable levels, the containment environment may be ready for packaging or batching.

In some embodiments, it is contemplated that the purging of ambient air and filling with inert gas may occur simultaneously. In such embodiments, the inert gas may be forced into the chamber through an intake portion, such as intake portion 108 of FIG. 1. While the inert gas may be forced into the chamber, the vacuum pump connected to the exhaust portion may simultaneously pull gas from the main chamber, such as from an opposite end of the main chamber. In some embodiments, the introduction of inert gas through the intake portion and simultaneous pulling of gas from inside the main chamber out through the exhaust portion may continue until the target gas concentration (e.g., oxygen concentration), may be less than about 0.2% or other maximum allowable gas concentration level. This simultaneous introduction and exhaust method may be used with either flexible or rigid chamber walls, but may be most useful with rigid chamber walls.

At 412, the method may include packaging products using the equipment within the containment environment. Packaging may include transferring key ingredients, such as serums, from bulk containers into individual containers, such as bottles for consumer use. In some embodiments, the bulk containers may only be opened once within the sealed containment environment. In some embodiments, the serum or other product may be transferred from the bulk container into a doser. The doser may include a funnel or hopper to hold the product for packaging. Bottles or other packages may be filled with the doser to the desired levels. In some embodiments, the bottles may be sealed with an airless actuator using a capper. Once packaging is complete and the product is once again sealed off in a bottle or other container, the method may include, at 414, unsealing the containment environment such as by opening any access points. At 416, the method may include removing the packaged products from the containment environment for storage or transport.

In some embodiments, all or some of the steps described above with respect to FIG. 4 and method 400 may be performed either manually or automatically. For example, in some embodiments, the system may include one or more processors in communication with sensors inside or outside or the containment environment, and may be in communication with components of the containment environment such as the vacuum pump, the intake and exhaust valves, the inert gas regulator, etc. In such embodiments, the one or more processors may also be in communication with a memory containing processor-executable instructions to, among other things, open and close the intake and exhaust valves, activate the vacuum pump to remove ambient air from the containment environment, and activate the inert gas regulator to introduce inert gas into the containment environment. In some embodiments, the processor-executable instructions may include instructions to receive readings from sensors within the containment environment (such as pressure, temperature, oxygen concentration, etc.) and, based at least partially on those readings, open or close particular valves or activate removal or insertion of gases from the containment environment. For example, in some embodiments, the processor-executable instructions may include instructions to seal the containment environment, open the exhaust valves, and activate the vacuum pump to remove ambient air from the containment environment until the oxygen concentration or other target gas concentration within the containment environment is less than about 0.2% as registered on the sensors or another targeted level. Based on the reading, the processor-executable instructions may then instruct the exhaust valves to close, instruct the intake valves to open, and instruct the inert gas regulator to introduce inert gas into the containment environment until a predetermined pressure has been achieved. In some embodiments, the processor-executable instructions may include instructions to repeat the purging and filling process a predetermined number of times, or until the sensors determine that the concentration of target gas is below a predetermined target. Of course, those skilled in the art will recognize that other steps in the methods described herein may be executed in accordance with the disclosure.

In some embodiments, the filling and capping process described above may include spraying or blasting packaging components with jets of inert gas before and/or during filling and capping. Such an inert gas blasting procedure may be performed within a containment environment such as the containment environments 100, 200, 300 described with respect to FIGS. 1-3, or may be performed in embodiments without an enclosed containment environment at all. For example, in some embodiments, a nozzle supplying jets of inert gas (e.g., nitrogen, argon, helium, etc.) may provide bursts of relatively high velocity inert gas into the packaging that may forcefully displace the target gas (e.g., oxygen). In some embodiments, various packaging components (e.g., bottle interior, bottle exterior, actuator pump, actuator nozzle, etc.) may be blasted in order to remove molecules of the target gas that may cling to the packaging components even if the surroundings have been substantially purged of the target gas. In some embodiments, such a blast of inert gas may occur before the bottle is filled with product. In some embodiments, the blast may be streamed along with the product (e.g., serum) as it is dispensed into the bottle. Additionally, in some embodiments, another burst of inert gas, either from the same nozzle or another nozzle, may be applied to a bottle cap or actuator to be applied to the bottle for sealing. The inert gas burst may be applied from above and/or below the actuator to forcibly displace the target gas from the actuator and its surfaces. In some embodiments, the actuator may be activated (i.e., pumped) as the inert gas maybe applied over and around the actuator to further purge the target gas from within the mechanics of the actuator and dispensing nozzle of the actuator.

Figure 5:
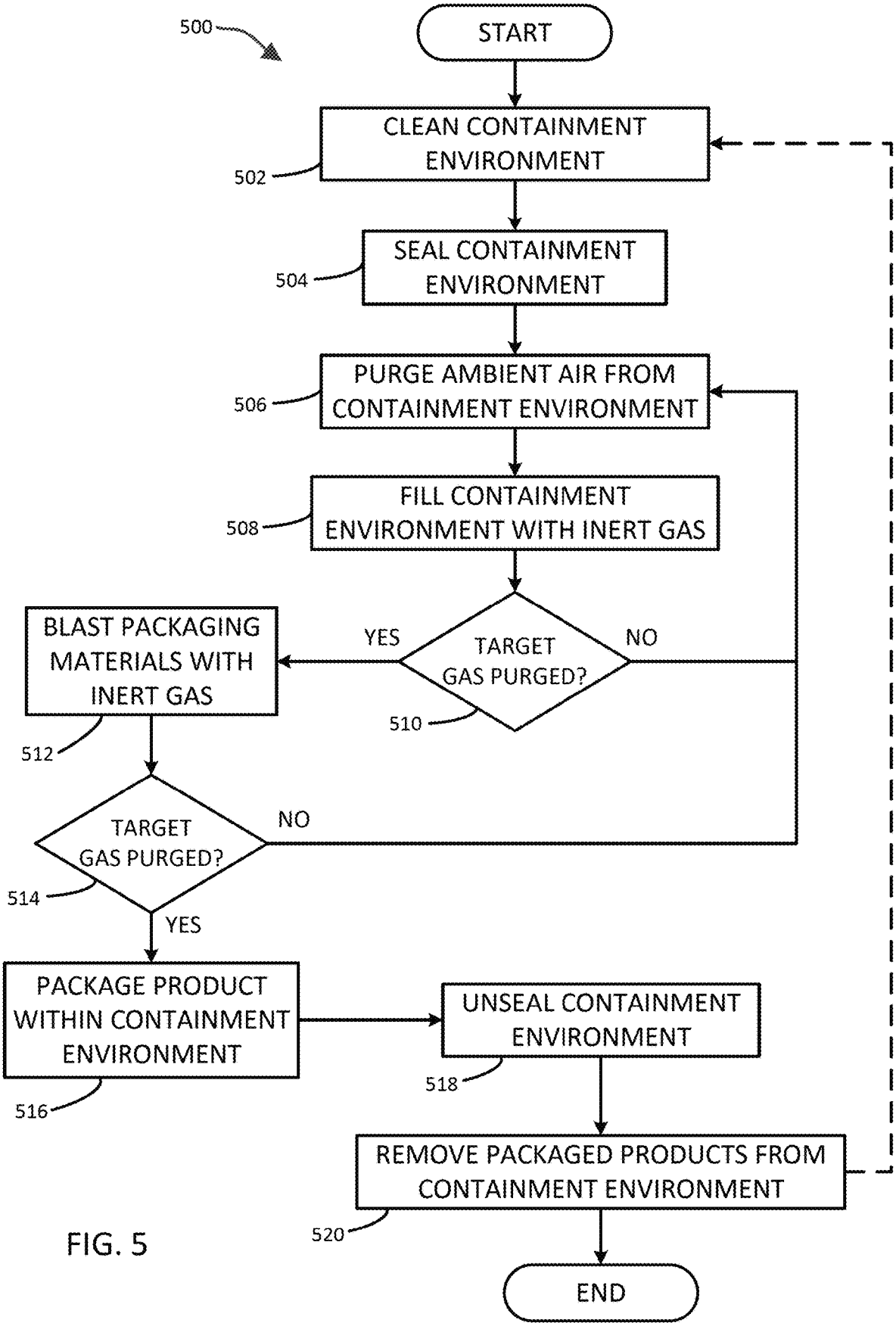
FIG. 5 is a flow chart illustrating another embodiment of a method of packaging a product in a substantially oxygen free environment in accordance with the disclosure.

The inert gas blast treatment described above may occur within a sealed, purged containment environment, without a sealed containment environment, or within a partially-enclosed space by supplying a steady drip of the inert gas. FIG. 5 is a flow chart 500 illustrating an embodiment of a method of implementing the inert gas blasting procedure above in tandem with a sealed containment environment, such as containment environments 100, 200, 300 in FIG. 103. Similar to the embodiment described in flow chart 400 in FIG. 4, the embodiment shown in the flow chart 500 may include cleaning the containment environment at 502, sealing the containment environment at 504, purging ambient air from the containment environment at 506, and filling the containment environment with inert gas at 508. As described above, in some embodiments, the purging of ambient air and filling with inert gas steps 506, 508 may occur simultaneously. At 510, the method may include determining whether the target gas has been purged from the containment environment, such as via a sensor to determine whether the target gas concentration is less than or equal to a target gas maximum concentration. In some embodiments, the target gas maximum concentration may be less than or equal to 0.2%, 0.5%, 0.75%, 1.0%, 1.5%, or 2.0%.

At 512, the method may include blasting packaging materials with inert gas. As described above, the inert gas may be provided into the containment environment with tubs or nozzles with a source outside the containment environment or a source (e.g., tank of nitrogen gas) disposed and sealed inside the containment environment. Once the blasts of inert gas has been applied to the packaging, it is possible that molecules of the target gas that have been removed from packaging surfaces during the inert gas purge may cause the concentration of the inert gas within the containment environment to rise. Accordingly, at 514, the method may include again determining whether the target gas has been purged from the containment environment. As described above, this may include determining whether the target gas concentration may be below a predetermined maximum target gas concentration or saturation, such as less than or equal to 0.2%. If the target gas concentration is found to exceed the maximum target gas concentration, the method may include returning to purge ambient air from the containment environment at 506 and filling the containment environment with inert gas at 508, etc. If, at 514, the concentration of target gas may be at or below the maximum target gas concentration, the containment environment may be considered purged. At 516, once the containment environment may be purged, the method may include packaging the product within the containment environment that may be substantially free from the target gas (e.g., oxygen) and of UV light that may degrade the product. Once the product has been packaged and sealed, the method may include unsealing the containment environment at 518 and removing the packaged products from the containment environment at 520.

Figure 6:
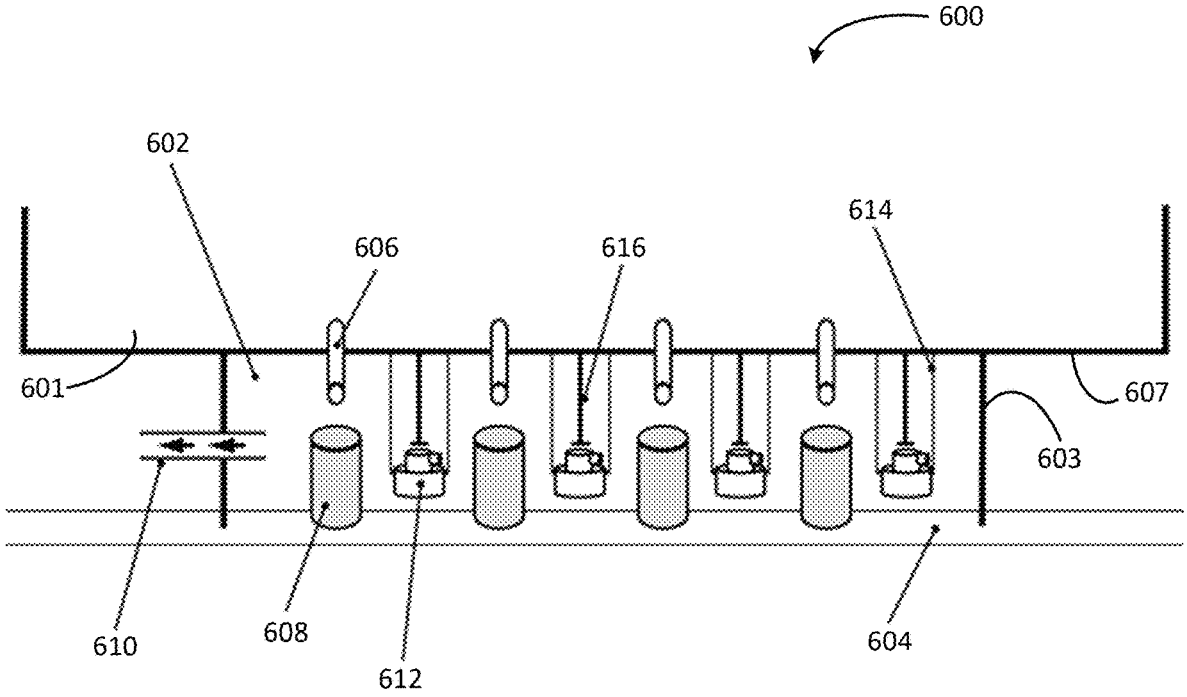
FIG. 6 is a diagram of an embodiment of an apparatus for packaging a product within a substantially oxygen-free environment in accordance with the disclosure.

FIG. 6 illustrates another embodiment of an apparatus 600 for a substantially oxygen-free packaging environment. The apparatus 600 may include a hood 601 with a bottom surface 607 and one or more chamber walls 603 that may define a containment environment 602 between the hood and a conveyer surface 604. In some embodiments, the hood 601 may extend over the containment environment 602 and the chamber walls 603 may surround the containment environment on all sides. In some embodiments, the chamber walls 603 may be connected to the bottom surface 607 of the hood 601 such that the walls may be lifted upwards and away from the conveyer surface 604 to open the containment environment 602. In some embodiments, the conveyer surface 604 may instead or also be moved downward away from the hood 601 and chamber walls 603 to open the containment environment. In some embodiments, contact between the chamber walls 603 and the conveyer surface 604 may form a substantially air-tight seal so to substantially prevent ambient air from entering the containment environment when the chamber walls are in place against the conveyer surface.

In some embodiments, the apparatus 600 may include one or more dual nozzles 606 that may supply both inert gas and/or dispense product into bottles 608 disposed within the containment environment 602, either separately or simultaneously. The apparatus 600 may also include at least one purging valve 610, which may be a one-way purging valve configured to allow ambient air or other gasses to escape from the containment environment 602 but not allow any gases to enter the containment environment. The conveyer surface 604 may be a conveyer belt that may selectively move packaging equipment laterally to be disposed within the chamber walls 603, or may be or any other suitable surface for holding and conveying packaging material such as bottles, caps, actuators, etc. In some embodiments, the conveyer surface 604 may be movable vertically so as to engage sealing ends of the chamber walls 603 and establish a substantially sealed containment environment 602. In some embodiments, the conveyer surface 604 may hold one or more bottles 608 and corresponding one or more caps or pump actuators 612. The pump actuators 612 may be one-way airless pumps/actuators configured to be installed on top of the bottles 608 to seal the product inside and allow for product to be dispensed from the bottle without exposing the remaining product within the bottle to ambient air. In some embodiments, the apparatus may include additional gas valves directed toward the actuators 612.

In some embodiments, the hood 601 may contain or house equipment for supplying inert gas (e.g., nitrogen) and product (e.g., serum) to the dual nozzles 606 and inert gas to the additional gas valves. In some embodiments, the apparatus 600 may also include one or more lifting mechanisms 614 that may be connected to the hood 601 and disposed so as to pinch and lift actuators 612 during purging and inert gas blasting. Once the purge and blasting are complete, the lifting mechanisms 614 may seat the actuators 612 on each respective bottle 608 within the purged containment environment 602. The apparatus may also include one or more plungers 616 that may be configured to depress and/or release a pump mechanism on the actuators 612 during inert gas purging and blasting. In some embodiments, actuating the pump mechanism during the introduction or blasting of inert gas may provide for additional surfaces within the actuator to be cleared of the target gas particles (e.g., oxygen). In some embodiments, the dual nozzles 606 may dispense both product (e.g., serum) and inert gas (e.g., nitrogen) simultaneously. For example, in some embodiments, the dual nozzles 606 may include concentric tubes, such as an inner tube to supply the product and an outer tube to supply inert gas during product deployment. In some embodiments, blasting the bottle 608 with the inert gas while the product is being dispensed into the bottle may reduce the amount of target gas left clinging to the bottle when the product is introduced and thus maintain product integrity. Those of skill in the art will understand that alternative types of dual nozzles may also be used within the scope of this disclosure.

In some embodiments, the apparatus 600 may be used to package a product within a substantially oxygen-free environment by activating or otherwise moving the conveyer surface 604 to position one or more bottles 608 and actuators 612 underneath the hood 601 and within chamber walls 603. Specifically, a sealed environment may be placed directly above and around the one or more bottles 608 and actuators 612 which may be purged just prior to filling and capping the bottles. The actuators 612 may be held suspended and actuated (e.g., once, twice, or three times, etc.) while being blasted by inert gas such as nitrogen. In addition, the inside of the bottles 608 and the general space within the containment environment 602 may all blasted with the inert gas such that the atmospheric air may be purged from the containment environment. The conveyer surface 604 may then be moved vertically toward to engage with the chamber walls 603 and create a substantially airtight seal. One the bottles 608, actuators 612 and conveyer surface 604 are in place, in some embodiments, the lifting mechanisms 614 may lift the actuators 612 into place above the conveyer surface 604 and disposed so as to be subject to a blast of inert gas from one or more inert gas nozzles. While the inert gas nozzles may be blasting the actuators 612 with gas, the plunger 616 may actuate the pump mechanism on the actuator. Either simultaneously or independently, the dual nozzles 606 may blast the interior surfaces of the bottles 608 with inert gas, and may dispense product into the bottles. In some embodiments, the inert gas nozzles and the dual nozzles 606 may introduce enough inert gas into the containment environment 602 to substantially purge the containment environment of a target gas through the purging valve 610 prior to distribution of the product. Once the product has been distributed into the bottles 608, the lifting mechanisms 614 may seat each actuator 612 onto each respective bottle 608, sealing the product inside. Once each bottle 608 may be sealed, the conveyer surface 604 may move downward away from the chamber walls 603, convey the filled bottles away from the containment environment 602, and convey new empty bottles into the containment environment for filling. Upon such completion, the product within the bottles 608 may have encountered very little or none of the target gas molecules. In some embodiments, the apparatus 600 may operate automatically or manually.

The foregoing description and drawings merely explain and illustrate the invention and the invention is not limited thereto. While the specification is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements which, although not explicitly described or shown herein, embody the principles of the invention and, thus, within its scope and spirit.

What is claimed is:

1. A method for packaging products in a substantially oxygen free environment, the method comprising:

providing a containment environment including a main chamber formed by main chamber walls, an exhaust portion for removing ambient air from the main chamber, an intake portion for introducing inert gas into the main chamber, and a selectively sealable access point for providing access into and out of the main chamber;

providing an oxygen sensor disposed within the main chamber, the oxygen sensor configured to detect a concentration of oxygen present within the main chamber;

providing a bulk product dispenser and one or more individual bottles into the main chamber, wherein the bulk product dispenser contains a product including at least one of ascorbic acid or retinaldehyde and the one or more individual bottles each include a compressible portion configured for receiving the product;

sealing the main chamber at least by closing the sealable access point;

simultaneously purging ambient air from the main chamber through the exhaust portion and introducing inert gas into the main chamber through the intake portion until the oxygen sensor detects the concentration of oxygen in the main chamber to be less than or equal to a maximum oxygen concentration; and while the concentration of the oxygen is less than or equal to the maximum oxygen concentration:

transferring the product from the bulk product dispenser to the compressible portion of at least one of the one or more individual bottles; and sealing each of the compressible portions.

2. The method of claim 1, wherein each compressible portion is disposed within one of the one or more individual bottles so as to allow for selective dispensing of the product from each individual bottle without exposing the product within the compressible portion to ambient air.

3. The method of claim 1, wherein the containment environment further comprises one or more nozzles connected to one or more pressurized gas tanks of the inert gas, the nozzles configured to apply jets of the inert gas to surfaces of the bulk product dispenser and the one or more individual bottles.

4. The method of claim 1 further comprising:

providing one or more processors in communication with the oxygen sensor, a vacuum pump configured to remove the ambient air from the main chamber through the exhaust portion, and one or more pressurized tanks of the inert gas configured to supply the inert gas into the main chamber through the intake portion; and a memory containing processor-executable instructions to:

receive readings from the oxygen sensor indicating the concentration of oxygen within the main chamber, compare a concentration of oxygen to the predetermined maximum oxygen concentration, and deactivate the vacuum pump and the one or more pressurized tanks of the inert gas when the concentration of oxygen is determined to be less than or equal to the maximum oxygen concentration.

5. The method of claim 1 further comprising providing a doser into the main chamber; and wherein transferring the product from the bulk product dispenser to the compressible portion of at least one of the one or more individual bottles includes transferring the product from the bulk dispenser to the doser, and transferring the product from the doser to each compressible portion.

6. The method of claim 1 wherein the maximum oxygen concentration is about 0.2%.

7. A method for packaging products in a substantially oxygen free environment, the method comprising:

providing a containment environment including:

a main chamber formed by main chamber walls, an exhaust portion in fluid communication with the main chamber and a vacuum pump, an intake portion in fluid communication with the main chamber and one or more pressurized gas tanks containing an inert gas, and one or more nozzles connected to the one or more pressurized gas tanks, each of the one or more nozzles disposed within the main chamber;

providing a bulk product dispenser and one or more individual bottles into the main chamber, wherein the bulk product dispenser contains a product including at least one of ascorbic acid or retinaldehyde the one or more individual bottles each include a compressible portion configured for receiving the product;

sealing the main chamber at least by closing the sealable access point;

purging ambient air from the main chamber through the exhaust portion via the vacuum pump and introducing the inert gas from the one or more pressurized gas tanks into the main chamber through the intake portion until a concentration of a target gas is determined to be less than or equal to a maximum target gas concentration within the main chamber; and while the concentration of the target gas is less than or equal to the maximum target gas concentration:

using at least one of the one or more nozzles, simultaneously applying jets of the inert gas directly to at least one surface of the one or more individual bottles and dispensing the product from the bulk product dispenser into the compressible portion of the same at least one of the one or more individual bottles; and sealing each of the compressible portions.

8. The method of claim 7, wherein the product includes at least one ascorbic acid or retinaldehyde.

9. The method of claim 7 further comprising introducing the one or more individual bottles into the main chamber via a conveyor belt.

10. The method of claim 7 further comprising:

providing a target gas sensor within the main chamber, the target gas sensor configured to detect a concentration of a target gas present within the containment environment;

receiving, via one or more processors in communication with the target gas sensor, the vacuum pump, and the one or more pressurized tanks of inert gas, readings from the target gas sensor indicating the concentration of the target gas within the main chamber;

comparing, via the one or more processors, a concentration of the target gas to the maximum target gas concentration; and deactivating, via the one or more processors, the vacuum pump and the one or more pressurized tanks of the inert gas when the concentration of the target gas is determined to be less than or equal to the maximum target gas concentration.

11. The method of claim 10, further comprising:

receiving additional readings from the target gas sensor after the one or more nozzles has applied jets of the inert gas directly to at least one surface of the one or more individual bottles;

comparing, via the one or more processors, the concentration of the target gas to the maximum target gas concentration; and re-activating, via the one or more processors, the vacuum pump when the concentration of the target gas exceeds the maximum target gas concentration.

12. The method of claim 10 wherein the maximum target gas concentration is about 0.2%.

13. The method of claim 7 wherein the inert gas is one of nitrogen, argon, or helium.

14. A method for packaging products in a substantially oxygen free environment, the method comprising:

providing a bulk product dispenser and one or more individual bottles into a main chamber of a containment environment, wherein:

the main chamber is formed by main chamber walls, an exhaust portion for removing ambient air from the main chamber, an intake portion for introducing an inert gas into the main chamber, and a selectively sealable access point for providing access into and out of the main chamber, the bulk product dispenser contains a product including at least one of ascorbic acid or retinaldehyde, and each of the one or more individual bottles include a compressible portion configured for receiving the product;

providing an oxygen sensor disposed within the main chamber, the oxygen sensor configured to detect a concentration of oxygen present within the main chamber;

sealing the main chamber at least by closing the sealable access point;

simultaneously activating, via one or more processors, a vacuum pump to remove ambient air from the main chamber through the exhaust portion and supplying an inert gas into the main chamber through the intake portion;

receiving, via the one or more processors in communication with the oxygen sensor, readings from the oxygen sensor indicating the concentration of the oxygen within the main chamber;

comparing, via the one or more sensors, a concentration of the oxygen to a maximum oxygen concentration;

deactivating, via the one or more sensors, the vacuum pump when the concentration of oxygen is determined to be less than or equal to the maximum oxygen concentration; and while the concentration of oxygen is less than or equal to the maximum oxygen concentration:

transferring a product from the bulk product dispenser to the compressible portion of at least one of the one or more individual bottles; and sealing each of the compressible portions.

15. The method of claim 14, wherein the compressible portion is a compressible foil pouch.

16. The method of claim 14, wherein transferring the product from the bulk dispenser to each of the one or more individual bottles includes, using one or more dual nozzles.

17. The method of claim 16 further comprising simultaneously applying jets of the inert gas directly to at least one surface of the one or more individual bottles and dispensing the product from the bulk product dispenser into the one or more individual bottles via the one or more dual nozzles.

18. The method of claim 14 wherein the maximum oxygen concentration is about 0.2%.

19. The method of claim 14 wherein the inert gas is one of nitrogen, argon, or helium.

20. The method of claim 14 further comprising introducing the one or more individual bottles into the main chamber via a conveyor belt.

* * * * *